US010087737B2

(12) United States Patent
Bahorich

(10) Patent No.: US 10,087,737 B2
(45) Date of Patent: Oct. 2, 2018

(54) ENHANCED SECONDARY RECOVERY OF OIL AND GAS IN TIGHT HYDROCARBON RESERVOIRS

(71) Applicant: Mark E. Bahorich, Houston, TX (US)

(72) Inventor: Mark E. Bahorich, Houston, TX (US)

( * ) Notice: Subject to any disclaimer, the term of this patent is extended or adjusted under 35 U.S.C. 154(b) by 598 days.

(21) Appl. No.: 14/557,680

(22) Filed: Dec. 2, 2014

(65) Prior Publication Data

US 2015/0152719 A1 Jun. 4, 2015

Related U.S. Application Data

(60) Provisional application No. 61/911,501, filed on Dec. 4, 2013.

(51) Int. Cl.

| | |
|---|---|
| ***E21B 43/30*** | (2006.01) |
| ***E21B 43/24*** | (2006.01) |
| ***E21B 43/14*** | (2006.01) |
| ***E21B 43/17*** | (2006.01) |
| ***E21B 43/20*** | (2006.01) |

(52) U.S. Cl.

CPC ..... *E21B 43/30* (2013.01); *E21B 43/14* (2013.01); *E21B 43/17* (2013.01); *E21B 43/20* (2013.01); *E21B 43/24* (2013.01)

(58) Field of Classification Search

None

See application file for complete search history.

(56) References Cited

U.S. PATENT DOCUMENTS

| | | | | |
|---|---|---|---|---|
| 9,394,774 | B2 * | 7/2016 | Soliman | E21B 43/26 |
| 2009/0198477 | A1 * | 8/2009 | Benish | E21B 43/00 703/10 |
| 2013/0043024 | A1 * | 2/2013 | Stehle | E21B 43/24 166/272.3 |
| 2013/0105147 | A1 * | 5/2013 | Scott | E21B 43/14 166/245 |
| 2013/0206412 | A1 * | 8/2013 | Dale | E21B 43/30 166/298 |

* cited by examiner

*Primary Examiner* — Caroline N Butcher
(74) *Attorney, Agent, or Firm* — Richard A. Fagin

(57) ABSTRACT

A method for enhanced hydrocarbon recovery from a subsurface formation includes drilling and completing a plurality of laterally spaced apart wells through the formation so as to enable interference between adjacent ones of the plurality of wellbores. Fluid comprising surfactant is injected into the formation through at least one of the wellbores after an end of primary recovery from selected ones of the plurality of wellbores to initiate secondary recovery of hydrocarbons from the formation.

10 Claims, 2 Drawing Sheets

ENHANCED SECONDARY RECOVERY OF OIL AND GAS IN TIGHT HYDROCARBON RESERVOIRS

CROSS REFERENCE TO RELATED APPLICATIONS

Priority is claimed from U.S. Provisional Application No. 61/911,501 filed on Dec. 4, 2013.

STATEMENT REGARDING FEDERALLY SPONSORED RESEARCH OR DEVELOPMENT

Not Applicable.

BACKGROUND

This disclosure relates generally to enhanced hydrocarbon recovery from subterranean "tight" geological reservoir formations. "Tight" formations are known within the hydrocarbon extraction industry as geologic formations having a permeability less than 100 microdarcies. Recent technology advances have made possible "primary production", that is, hydrocarbons transported from subsurface reservoir formations to the Earth's surface substantially entirely by the energy contained in such subsurface hydrocarbon reservoir formations and/or fluid systems and artificial lift methods, from such reservoir formations. This disclosure relates more specifically to production methods to enhance "secondary" hydrocarbon extraction from such subsurface hydrocarbon reservoir formations, called "secondary recovery." Secondary recovery is understood by those skilled in the art to mean hydrocarbon extraction beginning after the primary phase of production and may be characterized by injection of fluids comprised of liquid or gaseous phases into the reservoir formation.

It is known in the art to drill and complete wells in tight formations and then use hydraulic fracturing treatments to improve fluid conductivity (permeability) along paths to the wellbore for hydrocarbons originally existing in the pore spaces of formations such as shale, mud, siltstone and other types of tight formations. Hydraulic fracturing treatments result in increased conductivity by injecting at high pressure a mix of fluids and proppant with beneficial chemical additives to open fractures in the formation. The fluid under pressure creates fractures in the formation and the proppant supports or "prop" the fractures open after the fluid injection has ended. The propped fractures enable primary recovery of hydrocarbons.

The reservoirs contemplated by this disclosure have low permeability and would be difficult to sustain a secondary recovery operation due to the costs associated with pumping fluid through a reservoir that has not been propped by hydraulic fracture. One of the techniques known in the art for hydraulic fracturing includes the use of a surfactant or surfactant blend (usually a mix of a surfactant and a co-surfactant) to improve the recovery of the largely aqueous phase of fracture treatment fluid from a wellbore that has been subjected to fracture treatment. It is believed that by increasing the surface recovery of fracture treatment water the fracture will have less relatively immobile fluid phases that restrict the effective flow rates or relative permeability of hydrocarbons in the formations back to the hydraulically fractured well. While the performance of the surfactants or surfactant blends vary based on compositions thereof, formation water salinity, temperature and pressure of the reservoir formation, some surfactants or blends are effective at creating an emulsion of varying scales of either water-in-oil or oil-in-water composition. Tight reservoirs are known in the art to be developed with several horizontal wells in close proximity to each other to maximize the contact of each well's hydraulic completion (i.e., the fracture zone subtended by each well) with the formation without having any well spaced close enough to any adjacent wells so as to have adjacent wells' fracture zones extending into the same hydrocarbons located in the reservoir.

SUMMARY

A method according to one aspect of the disclosure for enhanced hydrocarbon recovery from a subsurface formation includes drilling and completing a plurality of laterally spaced apart wells through the subsurface formation so as to enable hydraulic interference between adjacent ones of the plurality of wellbores. Fluid comprising surfactant is injected into the formation through at least one of the wellbores after an end of primary recovery from selected ones of the plurality of wellbores to initiate secondary recovery of hydrocarbons from the formation. Other aspects and advantages will be apparent from the description and claims which follow.

DETAILED DESCRIPTION

Figure 1:
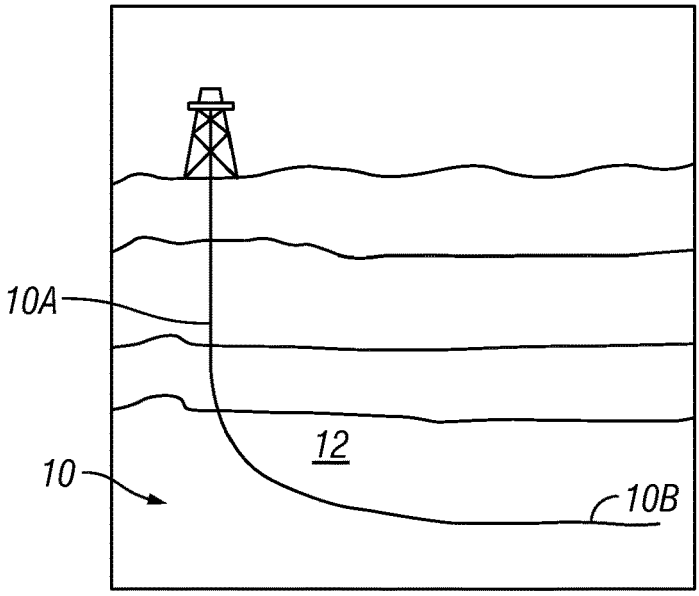
FIG. 1 (Prior Art)
FIG. 1 shows an example horizontal well configuration.

FIG. 1 shows an example of a typical horizontal well configuration that may be completed with a hydraulic fracture treatment. The fracture treatment may include pumping water, scale inhibitor, friction reducer, biocide, clay stabilizer, oxygen scavenger, surfactants and like chemicals with proppant material (e.g., sand, sand with a resin coating or ceramic particles or the like). The well 10 may be drilled from the surface initially substantially vertically, as shown at 10A. As the well 10 approaches a target formation 12, the well 10 may be directionally drilled to have its trajectory substantially match the geologic orientation of the target formation 12. The orientation of the well 10 in the target formation 12 may be horizontal, or any other angle.

Figure 2:
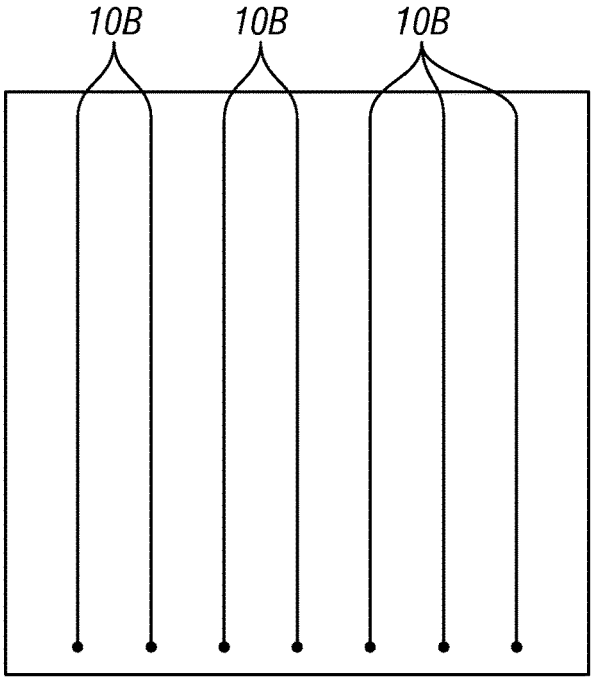
FIG. 2 (Prior Art)
FIG. 2 shows typical arbitrary well spacing (density) that is standard industry practice for producing from tight formations using primary recovery with hydraulic fracturing.

FIG. 2 shows a plan view of a typical shale, silt, mud or other tight reservoir development with a predetermined well spacing such that there is no or little apparent competition for reservoir hydrocarbons using reservoir engineering principles and methods known in the art such as rate transient analysis. The portions of the wells extending along the orientation of the target formation are shown at 10B as explained with reference to FIG. 1. These wells 10B may or may not be treated with a surfactant or surfactant package intended to increase recovery of largely aqueous-based fracture treatment fluids or inhibit clay water imbibition by the target formation (12 in FIG. 1). The wells 10B each may be fracture treated such that the lateral extent from each wellbore of the fracture treatment does not come into contact with the fractures extending from an adjacent wellbore 10B.

Figure 4:
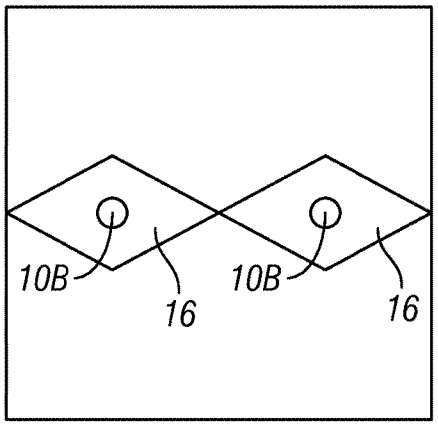
FIG. 4 (Prior Art)
FIGS. 4 and 5 shows a cross section of horizontal wellbores not having well interference and an arbitrary characterization of the area of the reservoir actively propped open following hydraulic fracture operations so as to have well interference, respectively.

The foregoing fracture treatment to avoid contact of the fracture treatment of any will with that of an adjacent well is shown in cross section in FIG. 4, wherein adjacent wellbores 10B and the fracture zones 16 extending therefrom substantially do not contact each other. Those skilled in the art will be able to determine for any type of target formation the lateral spacing between wellbores that may be used, and a lateral extent of the fracture zone that may be created so as not to induce contact between adjacent well fracture zones.

Figure 3:
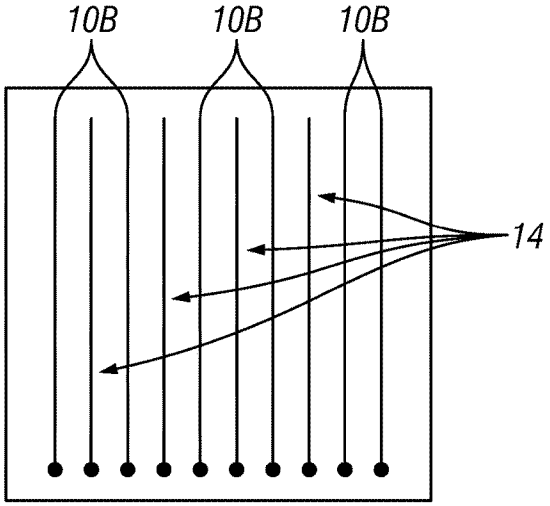
FIG. 3 shows how well density would increase in order to space wells so as to have well interference after hydraulic fracturing.

FIG. 3 shows in plan view one example embodiment of wells 10B, 14 drilled and completed according to the present disclosure. Primary producing wells 10B may be drilled and completed as shown in FIG. 2. "Infill" wells 14 may drilled after the initially drilled wells 10B ("primary producing wells") have been completed, fracture treated and primary production from such primary producing wells 10B is no longer economically feasible. The infill wells 14 in some embodiments may be drilled substantially contemporaneously with the primary producing wells 10B and left in place for later completion and treatment. The infill wells 14 in some embodiments may be drilled after primary production from the primary producing wells 10B is stopped. The infill wells 14 result in a plurality of wells through the target formation (12 in FIG. 1) intentionally spaced sufficiently closely such that hydrocarbon competition is observable using for example, fluid flow rate transient analysis. The infill wells 14 may be drilled either "toe up" or "toe down" and in any direction as long as they are substantially parallel in relative configuration. The spacing between the primary producing wells 10B and the infill wells 14 which will result in sufficient inter-well hydraulic communication may depend on the volumes of fluid and proppant used to complete the primary producing wells 10B and the infill wells 14 and the spacing at which hydraulic fracture treatment intervals are initiated (stages) in the reservoir development. The hydraulic fracture treatment intervals and the spacing between adjacent wells may be designed to account for the reservoir formation thickness, reservoir formation permeability, and mechanical properties of the target reservoir formation (12 in FIG. 1).

Figure 5:
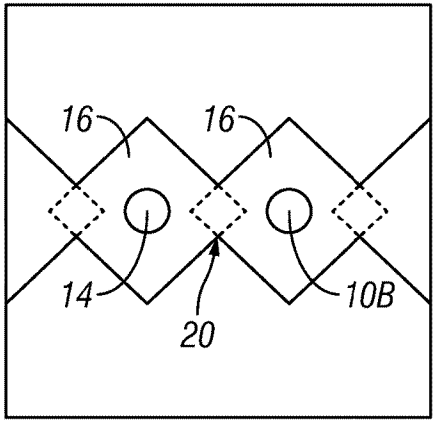

FIG. 5 shows schematically how an example of between-well spacing and fracture treatment according to the present disclosure may enable secondary recovery operations. Following primary production as explained above, well operators may begin secondary recovery methods. Such methods may include injecting fluids consisting of any of aqueous, hydrocarbon liquid, or gases of various compositions at selected temperatures and pressures into an injection well that was either previously a producing well (e.g., 10B in FIG. 2) or a well drilled and completed expressly for the purpose of injection, e.g., an infill well (14 in FIG. 3). That is, either the primary producing wells (10B in FIG. 3) or the infill wells (14 in FIG. 3) may be used for fluid injection. As shown in FIG. 5, the lateral spacing between adjacent wells 10B, 14 and the fracture zones 16 produced by fracture treatment after primary production has ended may result in hydraulically connected fractures between interfering fracture zones, shown at 20 in FIG. 5. A well used as an injection well may deliver reservoir management fluid to the reservoir formation for the purposes of, among others, pressure maintenance, hydrocarbon displacement, and hydrocarbon mobility improvement by temperature increase or emulsion creation.

Fluid injection programs such as the above described examples are known in the art to be used in conventional reservoirs (i.e., reservoirs that produce fluid from primary porosity of the formation instead of from fracture porosity) generally existing as a geologic trap and having permeability exceeding 100 microdarcies. Methods according to the present disclosure make use of the high permeability created in a "tight" reservoir (as defined above) by hydraulic fracturing. By having adjacent wells sufficiently close to each other, and by having hydraulically interfering fracture zones (20 in FIG. 5) there may be generated a conduit for secondary recovery fluid treatments to be efficiently used regardless of the type of secondary recovery treatment used. According to the present disclosure, any fluid introduced into the target formation through an injection well may have a surfactant as part of its composition with the purpose of increasing oil mobility in the target formation. Increasing oil mobility may enable further hydrocarbon recovery beyond that possible from primary recovery alone. The injected fluid may comprise either liquid or gas comprising at least one of carbon dioxide, water steam, water, hydrocarbon gas, and compounds selected to improve at least one of sweep efficiency and equipment maintenance. Further, the injected fluid may comprise materials or chemicals for increasing mobility of hydrocarbons by emulsification, viscosity modification, wetting of the formation and displacement.

In methods according to the present disclosure the surfactant or a multi-component surfactant composition may be injected as a stand-alone treatment or mixed with other chemicals such as biocides, clay stabilizers, scale inhibitors, oxygen scavengers and the like. One example of such treatment composition is sold under the trademark GASPERM 1000, which is a registered trademark of Halliburton Energy Services, Inc. 1-B-121, 2601 Beltline Road, Carrollton Tex. 75006. The foregoing composition is currently intended to be used for near wellbore and single well fracture treatments and may be extended for use in improving the mobility of hydrocarbons in a secondary recovery program.

Fluid injection methods according to the present disclosure may be differentiated from hydraulic fracture treatments known in the art by the absence therein of proppant materials in a secondary recovery utilization. Proppant may not be required because fluid may continue to be injected under pressure into the reservoir formations such that the injection pressure may keep fractures opened without the need for proppant particles as may be required in a well used to withdraw fluid from a reservoir formation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for enhanced hydrocarbon recovery from a subsurface formation, comprising:

drilling and completing a plurality of laterally spaced apart wellbores through the subsurface formation, the completing comprising fracture treating the plurality of laterally spaced apart wellbores in the subsurface formation, the plurality of laterally spaced apart wellbores having spacing therebetween selected so as to enable overlapping, physically connected fracture contact between fracture zones of adjacent ones of the plurality of laterally spaced apart wellbores; and injecting fluid comprising surfactant into fractures in the subsurface formation through at least one of the plurality of laterally spaced apart wellbores to initiate secondary recovery of hydrocarbons from the subsurface formation.

2. The method of claim 1 wherein the plurality of laterally spaced apart wellbores are drilled substantially contemporaneously.

3. The method of claim 1 wherein selected ones of the plurality of laterally spaced apart wellbores remain uncompleted until primary production from the completed ones of the plurality of laterally spaced apart wellbores is substantially finished.

4. The method of claim 1 wherein rate transient analysis is used to identify fracture zone overlap between the laterally spaced apart wellbores.

5. The method of claim 1 wherein well communication is maintained by injecting fluid into at least one of the plurality of wellbores.

6. The method of claim 1 where the injected comprises at least one of carbon dioxide, water steam, water, hydrocarbon gas, and compounds selected to improve at least one of sweep efficiency and equipment maintenance.

7. The method of claim 1 wherein the injected fluid comprises materials for increasing the relative permeability to hydrocarbons in a preferential direction toward at least one of the plurality of laterally spaced apart wellbores used to remove fluid from the formation.

8. The method of claim 1 wherein the injected fluid comprises chemicals for increasing mobility of hydrocarbons by at least one of emulsification, viscosity modification, wetting of the formation and displacement and combinations thereof.

9. The method of claim 1 wherein the formation has a permeability of at most 100 microdarcies.

10. The method of claim 1 wherein the secondary recovery is initiated after primary recovery of hydrocarbons from at least part of the subsurface formation is completed.

* * * * *